US005630453A

United States Patent [19]

Ishizawa

[11] Patent Number: 5,630,453

[45] Date of Patent: May 20, 1997

[54] DEBARKING MACHINE

[75] Inventor: Seiya Ishizawa, Shizuoka, Japan

[73] Assignee: Fuji Kogyo Co., Ltd., Shizuoka, Japan

[21] Appl. No.: 652,932

[22] Filed: May 24, 1996

[51] Int. Cl.[6] ..... B27L 1/00

[52] U.S. Cl. ..... 144/208.9; 144/341

[58] Field of Search ..... 144/208.1, 208.9, 144/341

[56] References Cited

U.S. PATENT DOCUMENTS

| | | | |
|---|---|---|---|
| 4,685,498 | 8/1987 | Nakajima et al. | 144/208.9 |
| 4,691,750 | 9/1987 | Nakajima | 144/208.9 |

FOREIGN PATENT DOCUMENTS

| | | |
|---|---|---|
| 61-141507 | 6/1986 | Japan . |
| 3-136805 | 6/1991 | Japan . |
| 5-50962 | 7/1993 | Japan . |

*Primary Examiner*—W. Donald Bray
*Attorney, Agent, or Firm*—Whitham, Curtis, Whitham & McGinn

[57] ABSTRACT

A debarking machine having a wood-infeeding side for feeding wood to the debarking machine and a wood-outfeeding side for outputting wood from the debarking machine, includes a line of first to n-th rotary members coupled in series, or a plurality of lines thereof coupled in series, from the wood-infeeding side to the wood-outfeeding side, each rotary member having a debarking blade on an outer surface. The first rotary member is inclined downwardly in a direction toward the wood-outfeeding side from the wood-infeeding side, and the second to n-th rotary members are arranged either horizontally or inclined downwardly in the direction toward the wood-outfeeding side from the wood-infeeding side. An inclined angle of the first rotary member located at an end of the wood-infeeding side is set greater than an inclined angle of the n-th rotary member located at an end of the wood-outfeeding side. Inclined angles of the second to (n−1)-th rotary members are set within a range from an angle no less than the inclined angle of the n-th rotary member to an angle no more than the inclined angle of the first rotary member, and are each set no less than the inclined angle of an adjoining rotary member which is located on the wood-infeeding side.

17 Claims, 12 Drawing Sheets

DEBARKING MACHINE

BACKGROUND OF THE INVENTION

1. Field of the Invention

The present invention relates to a debarking machine for debarking the bark of wood, and, more particularly, to a novel debarking machine which has a line of rotary members or plural lines of rotary members coupled in series and which is so designed that the inclined angle of the first rotary member located on the wood-infeeding side is set greater than the inclined angle of the n-th rotary member located at the wood-outfeeding side end, and the inclined angles of the second to (n−1)-th rotary members are set within a range from the inclined angle of the n-th rotary member to the inclined angle of the first rotary member and are each set equal to or greater than the inclined angle of the adjoining rotary member which is located on the wood-infeeding side, whereby the staying of wood on the wood-infeeding side and the shortage of wood on the wood-outfeeding side are prevented and the amount of wood per unit length becomes uniform over the entire process from the wood-infeeding side to the wood-outfeeding side, thus ensuring a smooth rotational motion of wood and preventing damage to the wood and insufficient debarking to thereby improve the overall debarking efficiency.

2. Description of the Related Art

One example of debarking machines is illustrated in FIGS. 10 and 11. The debarking machine shown in FIG. 1 has three debarking units 301 coupled in series. A loading hopper 303 is attached to the right debarking unit 301 in FIG. 10. Wood 305 is loaded into the right debarking unit 301 in FIG. 10 via this loading hopper 303.

Rotatably accommodated in each debarking unit 301 are rotors 307 and 309 each having a debarking blade 306 on the outer surface, as shown in FIG. 11. The rotor 309 is disposed farther from the rotor 307 in FIG. 10.

As the loaded wood 305 is moved leftward in FIGS. 10 and 11 on the rotating rotors 307 and 309, its bark is debarked by the debarking blade 306. The left debarking unit 301 in FIG. 10 is provided with a wood-discharge chute 311 through which the debarked wood 305 is discharged. The discharged wood 305 is conveyed by a wood-discharge conveyor 313.

The debarking operation will now be described in detail. FIG. 11 illustrates the interior of the debarking machine. Plural pieces of wood 305 are put on the rotors 307 and 309 and are revolved in the direction indicated by an arrow B in FIG. 11 while rotating in the direction of an arrow A in FIG. 11 in accordance with the rotations of the rotors 307 and 309. Accordingly, the lower wood 305 moves upward and the upper wood 305 comes downward, so that all the pieces of wood 305 evenly hit on the debarking blades 306 of the rotors 307 and 309. This motion is called the "rotational motion of wood." The "rotational motion of wood", if it is smooth, results in efficient debarking. As the "rotational motion of wood" takes place, the pieces of wood 305 are gradually moved leftward in FIGS. 10 and 11. This movement will now be discussed referring to FIG. 12.

As shown in FIG. 12, the rotors 307 and 309 are inclined downward in the direction toward the woodoutfeeding side from the wood-infeeding side by an inclined angle α. The wood 305 hits against the debarking blades 306 of the rotors 307 and 309 and is pushed upward in the direction of an arrow C (perpendicular to the rotors 307 and 309) in FIG. 12. The lifted wood 305 falls downward in the vertical direction as indicated by an arrow D in FIG. 12 and thus moves by a distance l. That is, while the lower wood 305 moves upward and the upper wood 305 moves downward, those pieces of wood 305 gradually move in the wood-discharge direction.

This conventional debarking machine has the following problems.

As shown in FIG. 10, the conventional debarking machine is inclined downward by a given inclined angle (α) from the wood-infeeding side (right side in FIG. 10) to the wood-outfeeding side (left side in FIG. 10). The inclination is for surely feeding loaded wood 305 to the wood-outfeeding side from the wood-infeeding side.

With this structure, however, a considerable amount of wood 305 stays on the wood-infeeding side and the amount of wood 5 on the wood-outfeeding side is reduced as shown in FIG. 10. This impairs the evenness of the overall amount of wood 305 per unit length, so that the wood 305 may be damaged and/or the debarking of the wood 305 becomes insufficient, thus significantly reducing the debarking efficiency.

Another cause for this problem is the irregular loading of wood 305. When a great amount of wood 305 stays on the wood-infeeding side, the rotational motion of wood 305 becomes insufficient and the same portions of the wood 305 hits on the debarking blades 306 more than necessary. Consequently, the wood 305 is damaged. Some wood 305, however, is not properly debarked by the debarking blades 306, thus resulting in insufficient debarking. As there is not much wood 305 on the wood-outfeeding side where the amount of wood per unit length is small, the load of pressing the wood 305 on the debarking blades 306 becomes insufficient and the debarking effect by the friction between pieces of wood 305 decreases, resulting in insufficient debarking.

If a considerable amount of wood 305 remains on the wood-infeeding side and the amount of wood 305 on the wood-outfeeding side is reduced, thus impairing the uniform amount of wood 305 per unit length, the overall debarking efficiency is decreased and the yield is reduced by the damage to the wood 305.

The prior art of this invention is illustrated in, for example, Unexamined Japanese Patent Publication Nos. Sho 61-141507,Hei 3-136805 and Hei 5-50962.

SUMMARY OF THE INVENTION

Accordingly, it is an object of the present invention to provide a debarking machine capable of preventing wood from remaining on the wood-infeeding side and the amount of wood from being reduced on the wood-outfeeding side to make the amount of wood per unit length even, thus ensuring a smooth rotational motion of wood to prevent damages on wood and to accomplish sufficient debarking to thereby improve the overall debarking efficiency.

To achieve the above object, a debarking machine according to this invention comprises a line of first to n-th rotary members coupled in series, or plural lines thereof coupled in series, from a wood-infeeding side to a wood-outfeeding side, each rotary member having a debarking blade on an outer surface, whereby the first rotary member is inclined downward in a direction toward the wood-outfeeding side from the wood-infeeding side and the second to n-th rotary members are arranged horizontally or inclined downward in the direction toward the wood-outfeeding side from the wood-infeeding side, an inclined angle of the first rotary member located at a wood-infeeding side end is set greater than an inclined angle of the n-th rotary member located at a wood-outfeeding side end, and inclined angles of the second to (n−1)-th rotary members are set within a range from an angle equal to or greater than the inclined angle of the n-th rotary member to an angle equal to or less than the inclined angle of the first rotary member and are each set equal to or greater than the inclined angle of an adjoining rotary member which is located on a wood-infeeding side.

With this structure, the wood feeding speed on the first rotary member to prevent wood from staying on the wood-infeeding side and the shortage of wood on the wood-outfeeding side, thus making the amount of wood per unit length uniform. The uniform amount of wood per unit length smoothes the rotational motion of wood and prevents damages on wood and insufficient debarking, thus improving the overall debarking efficiency.

Each of the rotary members may be rotatably accommodated in a housing to constitute a debarking unit.

The inclined angle of the first rotary member positioned at the wood-infeeding side end may be set greater than the inclined angles of the subsequent rotary members.

The inclined angles of the first rotary member positioned at the wood-infeeding side end and the second rotary member next to the first rotary member may be set greater than the inclined angles of the subsequent rotary members.

The inclined angles of those subsequent rotary members may be set the same.

The inclined angle of the first rotary member positioned at the wood-infeeding side end may be set to the maximum angle, and the inclined angles of the other rotary members may be reduced gradually toward the wood-outfeeding side.

The difference between the inclined angles of the adjoining rotary members may be set less than 6° .

The inclined angles of the rotary members may be adjustable.

Another debarking machine according to this invention comprises a line of first to n-th rotary members coupled in series, or plural lines thereof coupled in series, from a wood-infeeding side to a wood-outfeeding side, each rotary member having a debarking blade on an outer surface, whereby the first rotary member is inclined downward in a direction toward the wood-outfeeding side from the wood-infeeding side and the second to (n−1)-th rotary members are arranged horizontally or inclined downward in the direction toward the wood-outfeeding side from the wood-infeeding side, an inclined angle of the first rotary member located at a wood-infeeding side end is set greater than an inclined angle of the (n−1)-th rotary member located before a wood-outfeeding side end, and inclined angles of the second to (n−2)-th rotary members are set within a range from an angle equal to or greater than the inclined angle of the (n−1)-th rotary member to an angle equal to or less than the inclined angle of the first rotary member and are each set equal to or greater than the inclined angle of an adjoining rotary member which is located on a wood-infeeding side.

In this case, the n-th rotary member should be treated specifically so that to quicken the discharging of wood on the wood-outfeeding side, for example, the inclined angles of the rotary members should be increased by the inclined angle of the n-th rotary member.

DETAILED DESCRIPTION OF THE PREFERRED EMBODIMENTS

First Embodiment

Figure 1:
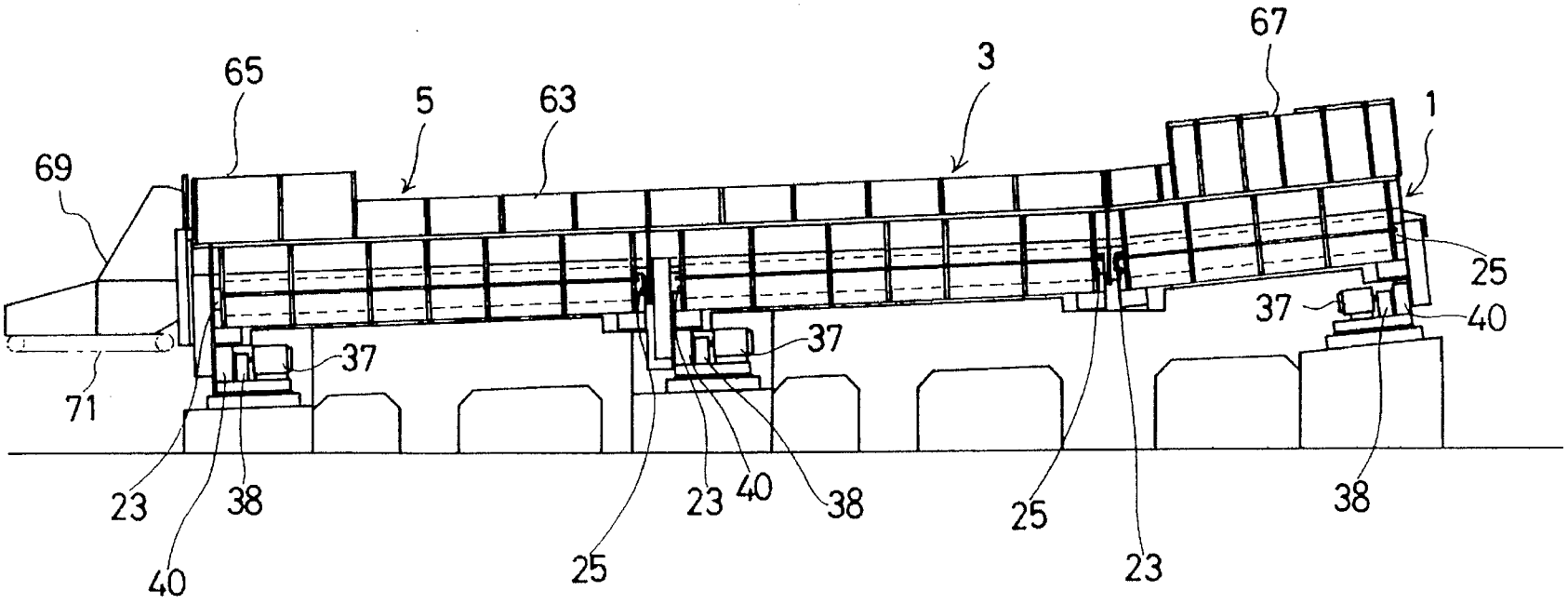
FIG. 1 is a side view showing the general structure of a debarking machine according to the first embodiment of the present invention.
Figure 2:
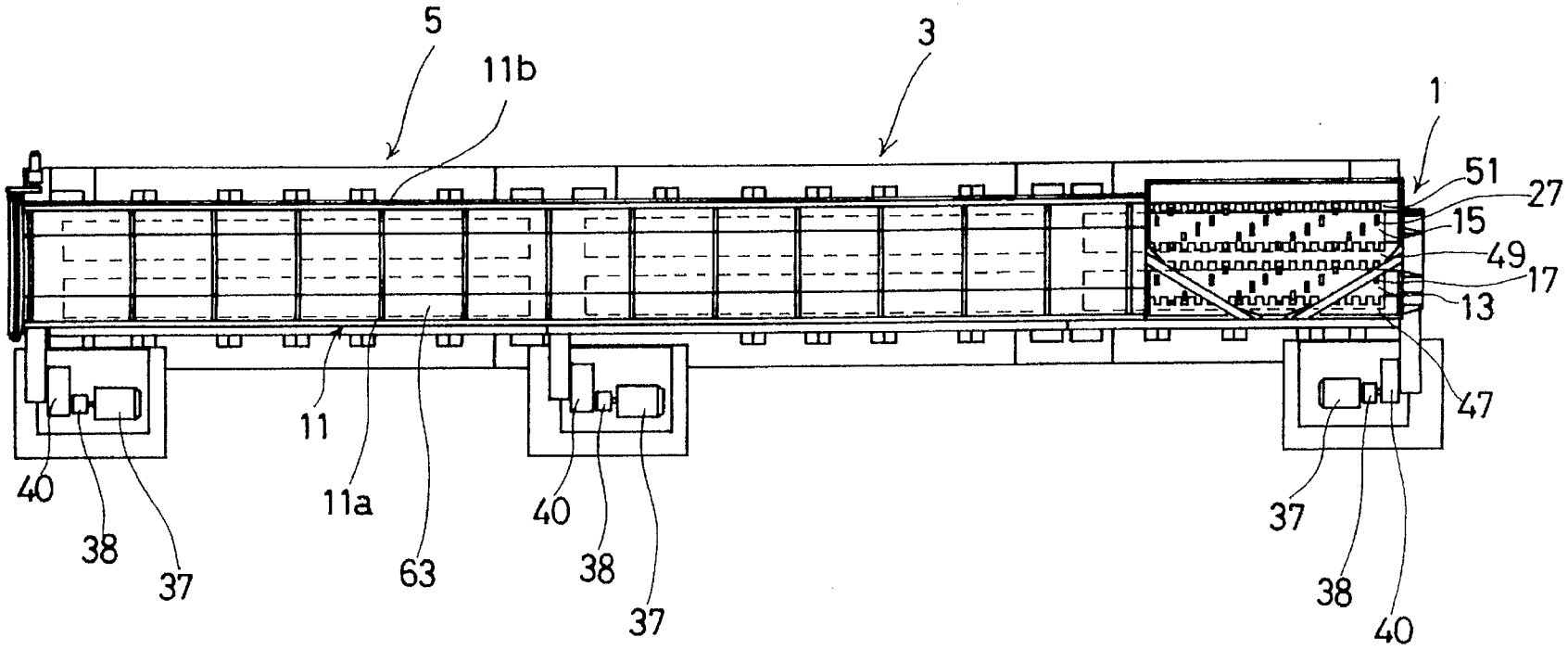
FIG. 2 is a plan view illustrating the general structure of a debarking machine according to the first embodiment.

The first embodiment of the present invention will now be described referring to FIGS. 1 through 7. FIG. 1 presents a side view showing the general structure of a debarking machine according to this embodiment. This debarking machine has a first debarking unit 1, a second debarking unit 3 and a third debarking unit 5 coupled in series. Wood 7 (shown in FIGS. 6 and 7) is loaded from the right end in FIG. 1 and is conveyed leftward in FIG. 1. As the wood 7 is moved, its bark is debarked after which the wood 7 is discharged from the left end in FIG. 1.

Figure 3:
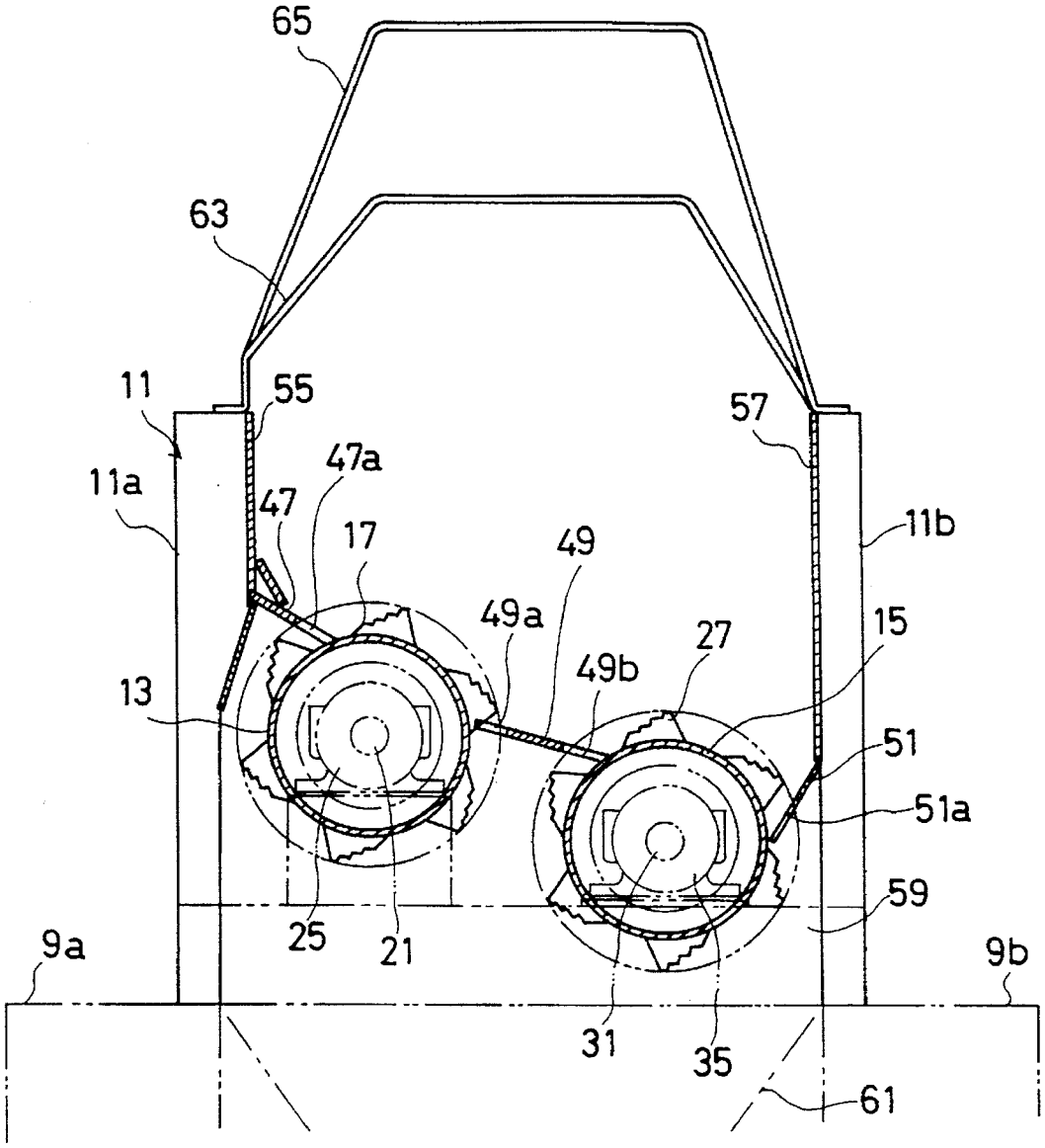
FIG. 3 is a lateral cross-section view illustrating the structure of a debarking unit according to the first embodiment.

The structures of the individual sections will now be discussed. Because the first debarking unit 1, the second debarking unit 3 and the third debarking unit 5 have basically the same structure, the structure of the third debarking unit 5 located at the left end in FIG. 1 will be described for the sake of descriptive convenience. As shown in FIG. 3, a housing 11 stands on bases 9*a* and 9*b*. The housing 11 has a pair of side walls 11*a* and 11*b* which are secured onto the bases 9*a* and 9*b*. Rotors 13 and 15 are rotatable disposed between those side walls 11*a* and 11*b*. The rotor 13 is located inclined to and above the rotor 15. The rotor 13 is cylindrical and has a plurality of debarking blades 17 on its outer surface. Shafts 19 and 21 are respectively fixed to both ends of the rotor 13, and are respectively supported in a rotatable manner by bearing members 23 and 25 via those shafts 19 and 21.

The rotor 15 has the same structure as the rotor 13. That is, the rotor 15 is cylindrical and has a plurality of debarking blades 27 on its outer surface. Shafts 29 and 31 are respectively fixed to both ends of the rotor 15, and are respectively supported in a rotatable manner by bearing members 33 and 35 via those shafts 29 and 31.

Figure 4:
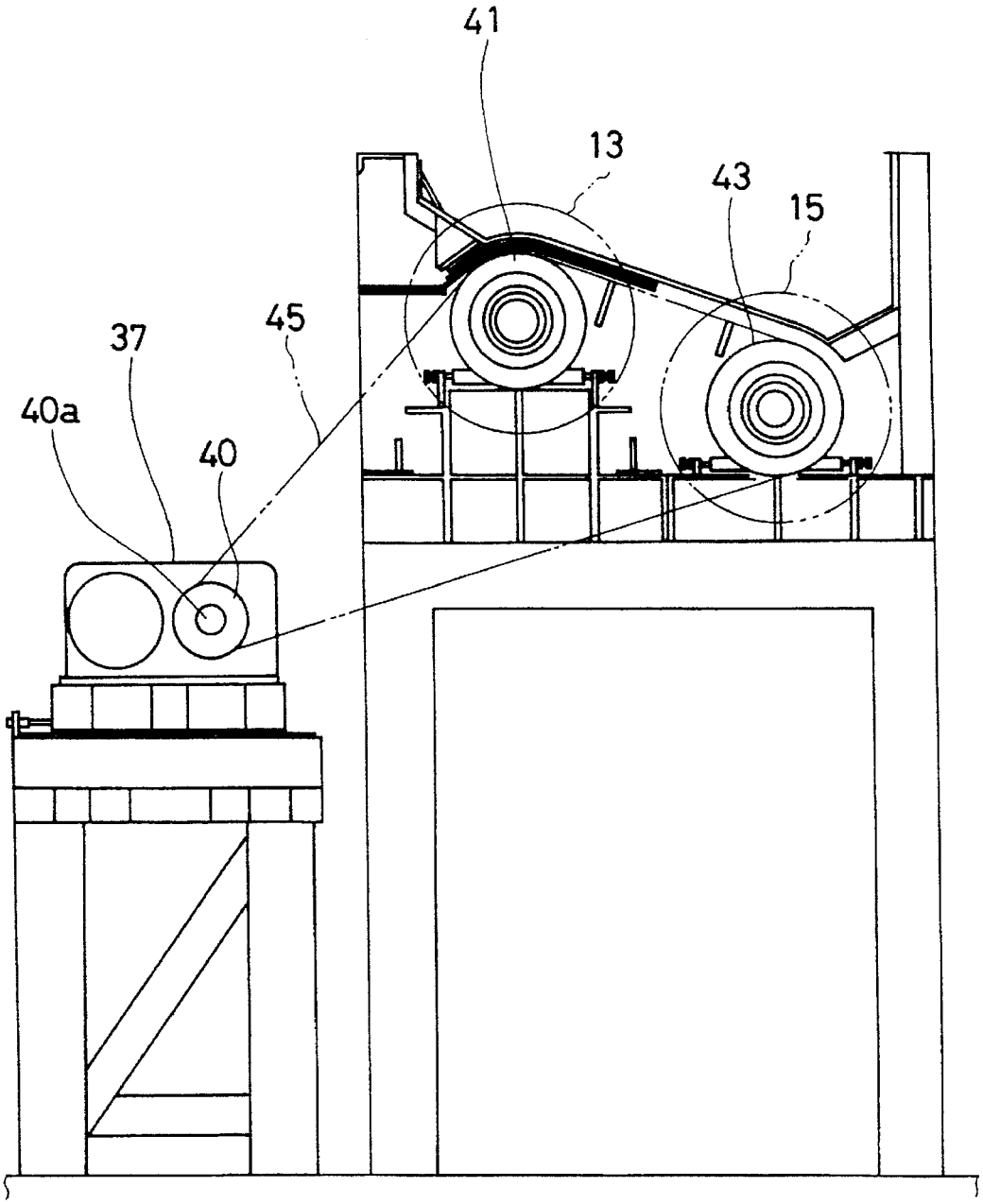
FIG. 4 is a side view illustrating the structure of a driving mechanism of the debarking unit according to the first embodiment.
Figure 5:
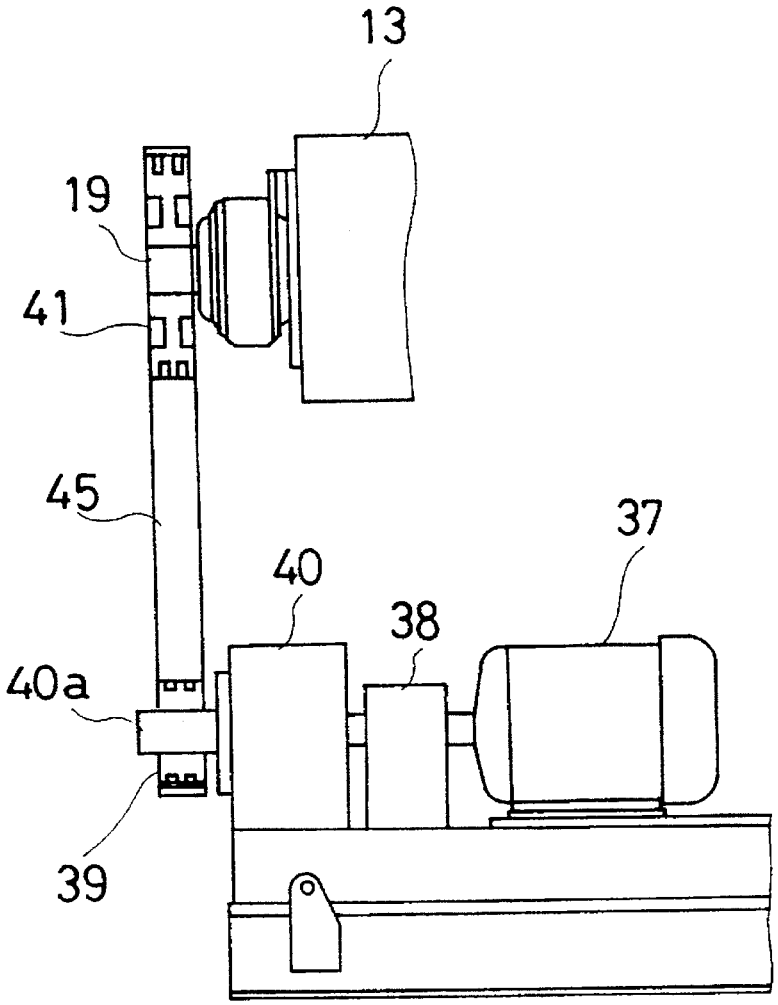
FIG. 5 is a front view showing the structure of the driving mechanism of the debarking unit according to the first embodiment.

FIGS. 4 and 5 illustrate the structure of a driving mechanism which rotates the rotors 13 and 15. The driving mechanism includes a drive motor 37 to which a coupling 38 and a reduction gear 40 are coupled, with a sprocket 39 fixed to the output of the reduction gear 40. Concentrically secured to the respective rotors 13 and 15 are sprockets 41 and 43 around which a chain 45 is put. As the drive motor 37 is driven, the rotors 13 and 15 rotate via the sprocket 39, the chain 45, and the sprockets 41 and 43.

Two sprockets may be concentrically secured to the drive motor 37 and separate chains may be put around the sprockets 41 and 43, respectively.

Returning to FIG. 3, provided between the rotor 13 and the side wall 11*a* is an inner wall 55 whose lower edge 47 is bent and extending toward the rotor 13. Provided between the rotor 15 and the side wall 11*b* is an inner wall 57 whose lower edge 51 is bent and extending toward the rotor 15. The lower edge 47 has a comb-like shape on the rotor side (13), forming a comb section 47*a*. The lower edge 51 likewise has a comb-like shape on the rotor side (15), forming a comb section 51*a*. A transfer guide plate 49 is provided between the rotors 13 and 15. This transfer guide plate 49 is shaped like a comb on both rotor sides (13 and 15), forming comb sections 49*a* and 49*b*. The debarking teeth 17 of the rotor 13 pass through the gaps in the comb sections 47*a* and 49*b*. The debarking teeth 27 of the rotor 15 pass through the gaps in the comb sections 51*a* and 49*b*.

As mentioned above, the inner walls 55 and 57 are attached to the inner walls of the side walls 11*a* and 11*b* above the rotors 13 and 15. A rotor base 59 and a bark chute 61 are provided below the rotors 13 and 15. An upper cover 63 is placed over the housing 11. As the third debarking unit 5 is located at the wood-outfeeding side end, it is provided with an upper cover 65 for the discharge section.

The first debarking unit 1 and the second debarking unit 3 basically have about the same structure as the third debarking unit 5. It is however to be noted that because the first debarking unit 1 is located on the wood-infeeding side end, it is provided with a wood-loading hopper 67 and a driving mechanism for driving the rotors 13 and 15 is located on the opposite side to those of the second debarking unit 3 and the third debarking unit 5. Disposed at the wood-outfeeding side end in the third debarking unit 5 is a wood-discharge chute 69 under which a wood-discharge conveyor 71 is provided.

The inclined angles of the first debarking unit 1, the second debarking unit 3 and the third debarking unit 5 will be discussed below. To begin with, the first debarking unit 1 is inclined downward by an inclined angle of b° in the direction toward the wood-outfeeding side from the wood-infeeding side (in the direction from the right side to the left side in FIG. 1), as shown in FIG. 1. Likewise, the second and third debarking units 3 and 5 are inclined downward by an inclined angle of a° in the direction toward the wood-outfeeding side from the wood-infeeding side (in the direction from the right side to the left side in FIG. 1). The inclined angles a° and b° have the relation of a°<b°. In other words, the inclined angle of the first debarking unit 1 is set greater than those of the second and third debarking units 3 and 5. In this embodiment, b° is 3° and a° is 2.5°.

The action of the thus constituted debarking machine will be described below.

Figure 7:
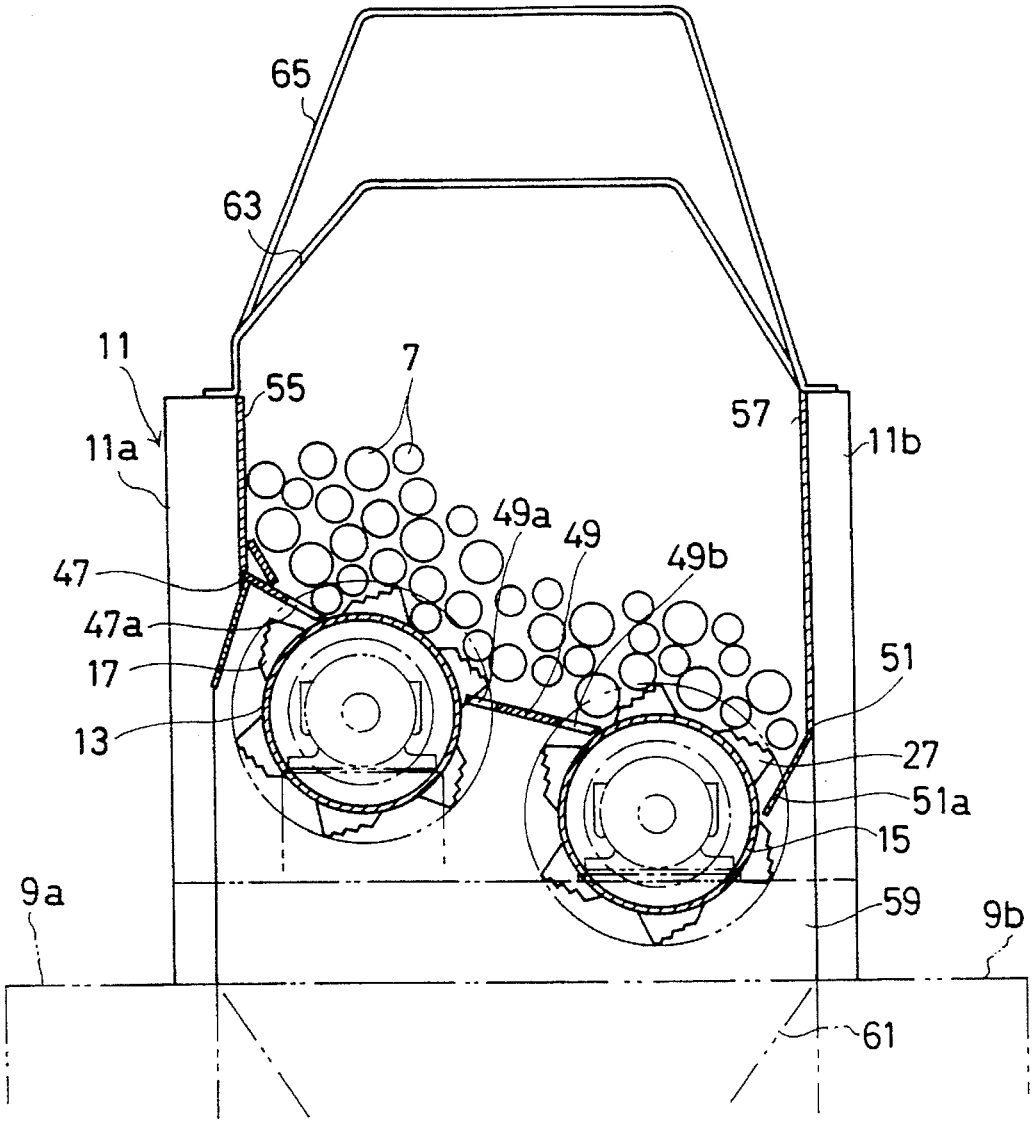
FIG. 7 is a lateral cross-section view of the debarking unit according to the first embodiment, showing how pieces of wood are placed.

Multiple pieces of wood 7 are loaded into the housing 11 of the first debarking unit 1 via the wood-loading hopper 67 placed above the first debarking unit 1. The rotors 13 and 15 in the first debarking unit 1 are activated so that the loaded pieces of wood 7 are debarked by the actions of the debarking blades 17 and 27 of both rotors 13 and 15 and the friction between the pieces of wood 7, as shown in FIG. 7. The debarked barks fall below the rotors 13 and 15 and are discharged via the bark chute 61. Those pieces of wood 7 are sequentially conveyed from the first debarking unit 1 toward the second debarking unit 3 and the third debarking unit 5 to be debarked, and will finally be discharged through the wood-discharge chute 69. The discharged pieces of wood 7 are conveyed on the wood-discharge conveyor 71.

Figure 6:
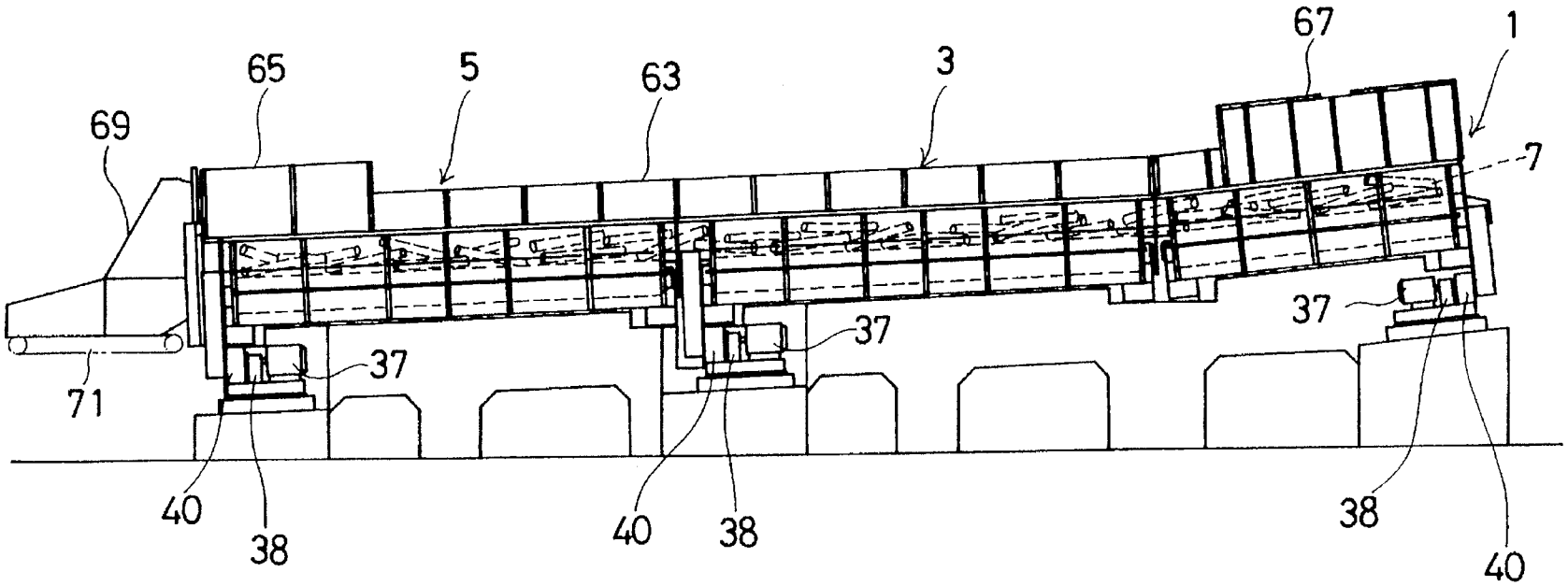
FIG. 6 is a side view illustrating the general structure of the debarking machine according to the first embodiment and the flow of wood.

In this embodiment, no great amount of wood 7 remains in the first debarking unit 1 in this sequence of debarking operations, as shown in FIG. 6. This is because the inclined angle b° of the first debarking unit 1 is set greater than those a° of the second and third debarking units 3 and 5. More specifically, the greater inclined angle of the first debarking unit 1 quickens the speed of feeding the wood in the first debarking unit 1, thus preventing the wood 7 from staying therein. The prevention of the wood 7 from staying makes the rotational motion of the wood 7 smoother, thereby preventing a piece of wood 7 from hitting the debarking blades 17 and 27 to be damaged or from missing the debarking blades 17 and 27 so that this wood 7 is not debarked.

Unlike in the prior art, the amount of wood 7 in the third debarking unit 5 on the wood-outfeeding side would not be too thin, so that multiple pieces of wood 7 flow with a uniform density over the range from the first debarking unit 1 to the third debarking unit 5. This feature prevents the pressures on the debarking blades 17 and 27 on the wood-outfeeding side from becoming insufficient for the debarking action, so that the overall debarking is conducted efficiently, thus improving the debarking efficiency.

To prevent the wood 7 from staying on the wood-infeeding side, the general inclined angle may be increased. In this case, however, the moving speed of wood becomes faster and the debarking amount per unit length is reduced. To effect the necessary debarking, therefore, the length of the overall debarking machine should be increased. This embodiment do not however require such an increase in overall length. That is, this embodiment can prevent the wood 7 from remaining in the wood-loading section and can thus improve the debarking efficiency without elongating the machine. In addition, the mentioned increase in the inclined angle cannot ensure the even density of pieces of wood 7.

Second Embodiment

Figure 8:
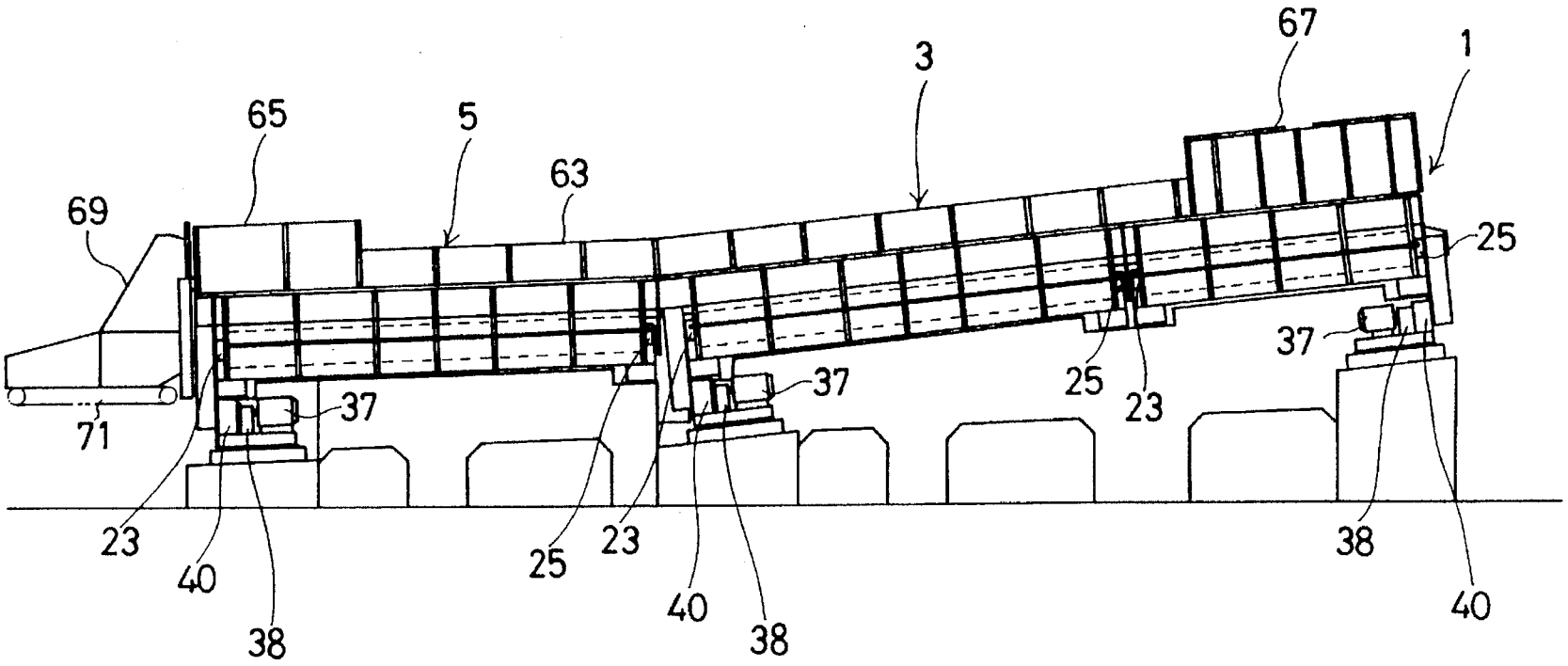
FIG. 8 is a side view showing the general structure of a debarking machine according to the second embodiment of this invention.

The second embodiment of this invention will now be described with reference to FIG. 8. In the second embodiment, the first debarking unit 1 and the second debarking unit 3 have inclined angles b° and the third debarking unit 5 has an inclined angle a° smaller than b° (b°>a°). This structure can also have the same advantages as the first embodiment.

Third Embodiment

Figure 9:
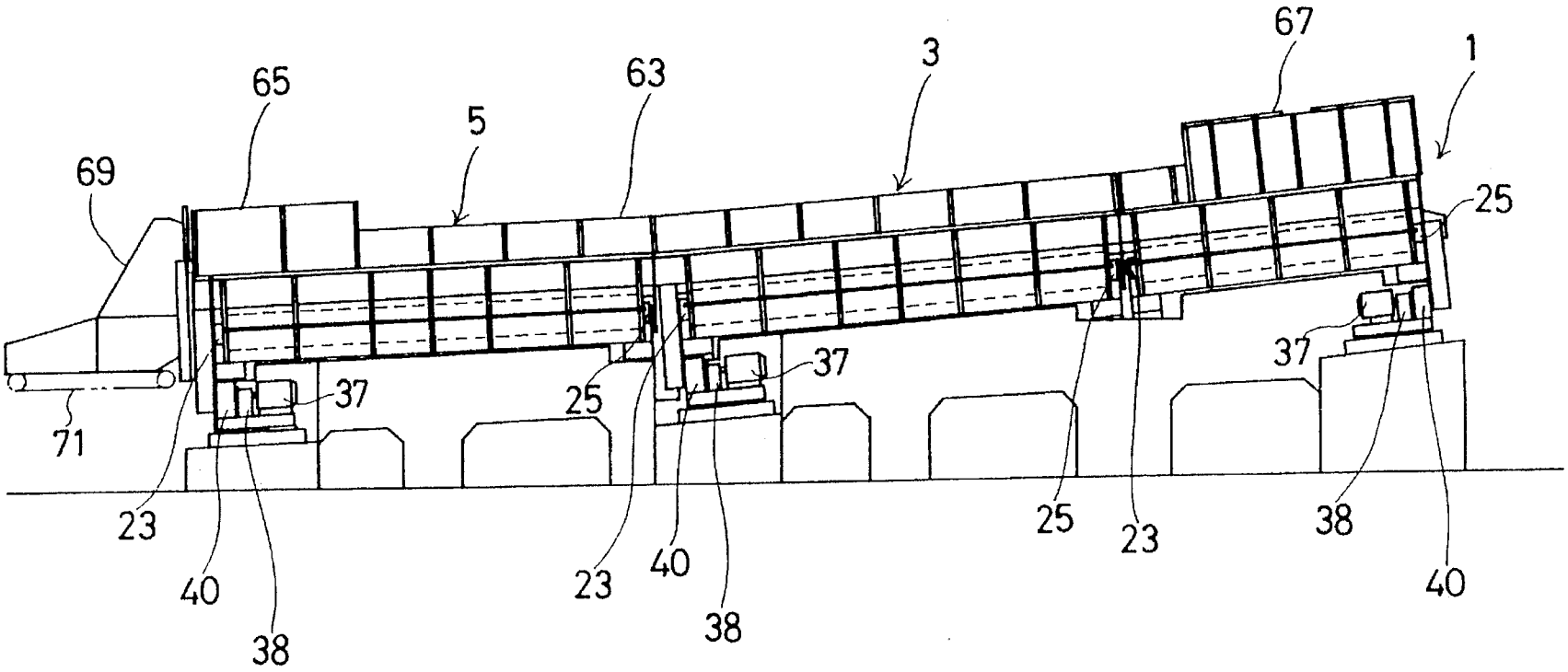
FIG. 9 is a side view depicting the general structure of a debarking machine according to the third embodiment of this invention.
Figure 10:
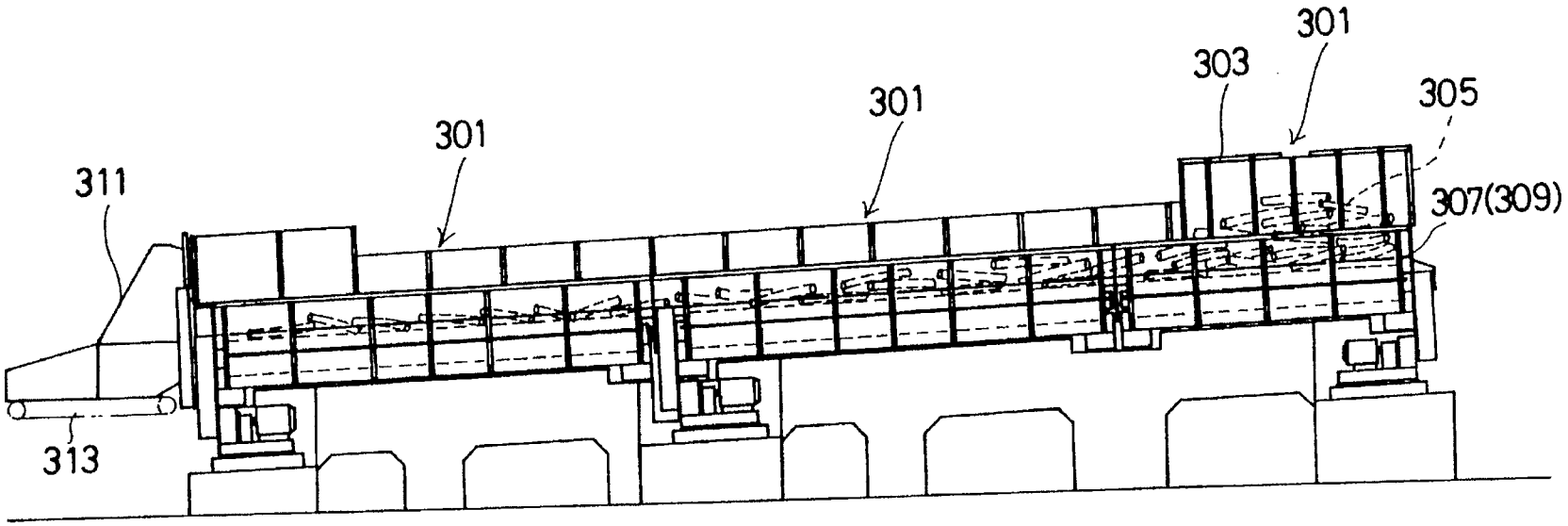
FIG. 10 is a side view illustrating the general structure of a debarking machine according to the prior art.
Figure 11:
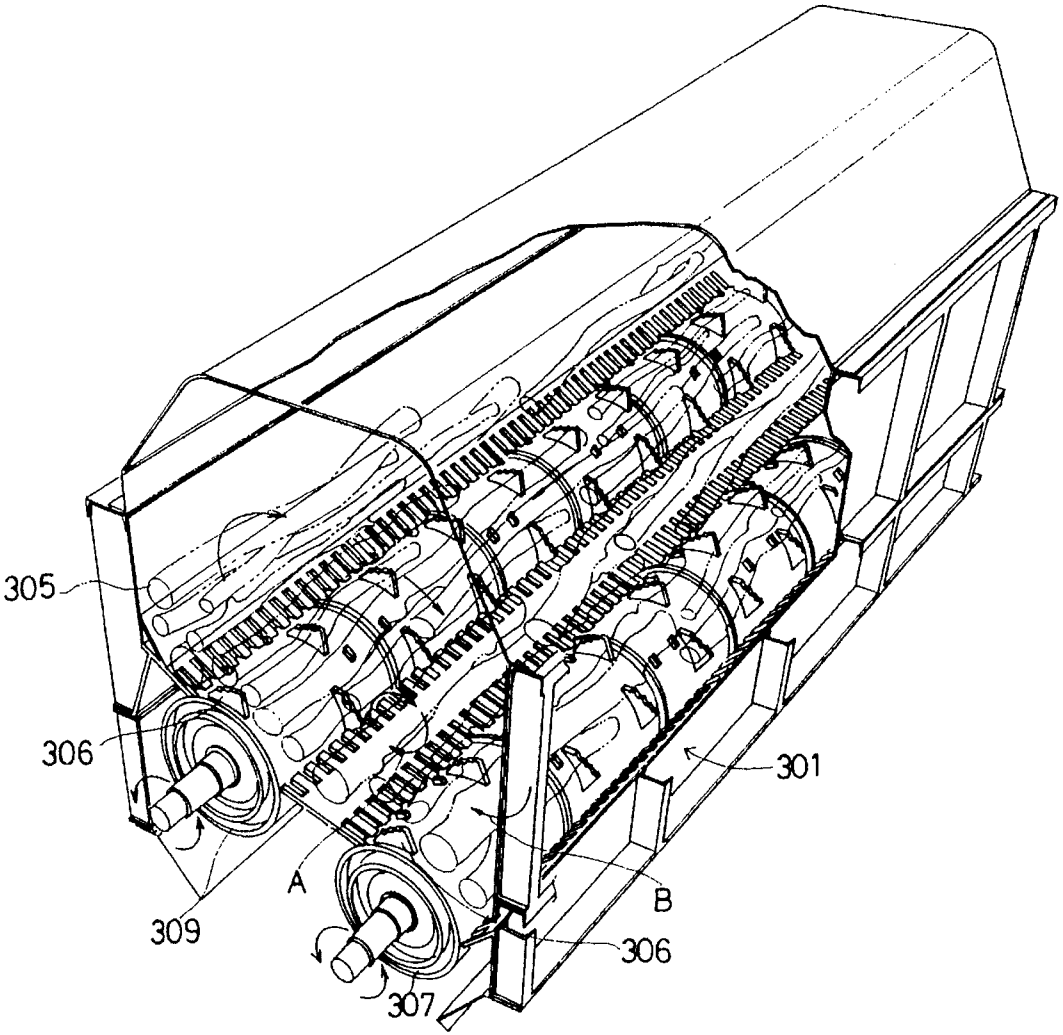
FIG. 11 is a perspective view showing the rotational motion of wood in the debarking machine.
Figure 12:
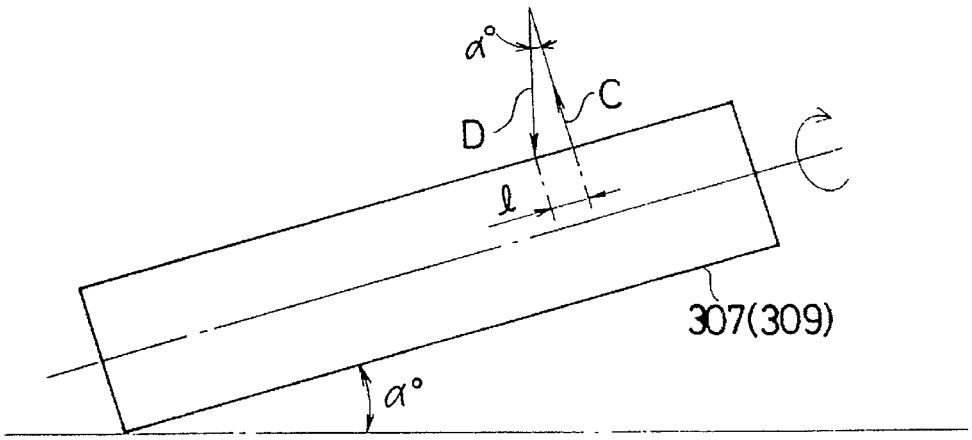
FIG. 12 is a diagram illustrating how wood is moved by the inclined rotors.

The third embodiment of this invention will now be described with reference to FIG. 9. In the third embodiment, the first debarking unit 1 has an inclined angle c°, the second debarking unit 3 has an inclined angle b° and the third debarking unit 5 has an inclined angle a°, and those inclined angles are in the relationship of c°>b°>a°. Likewise, this structure can have the same advantages as the first embodiment.

This invention is not limited to the first to third embodiments.

For example, although three debarking units are coupled in series in the first to third embodiments, this invention is also adaptable to a debarking machine with two debarking units, or four or more debarking units.

Although the rotary members are accommodated in the housings to form module-type debarking units in the first to third embodiments, this invention is not limited to this module type. This invention may also be adapted to a debarking machine in which a plurality of rotary members coupled in series are retained in a single housing.

The above values for the inclined angles are to be considered as illustrative and not restrictive, and may be set as needed. It is however desirable that the difference between the inclined angles of the adjoining rotary members be set within 6°.

The structures of the individual debarking units are not particularly restricted to those illustrated above, but this invention may be adapted to a debarking unit which uses a single rotor or three or more rotors.

In setting the inclined angles of the rotary members as specified in this invention, the structure may be modified so that the inclined angles of the rotary members are previously adjustable. More specifically, one side of each debarking unit may be lifted up or down by a hydraulic cylinder as disclosed in Unexamined Japanese Patent Publication No. Hei 3-136805 which has been mentioned in the Description of the Related Art.

Of first to n-th rotary members, the last n-th rotary member may be excluded from consideration and the inclined angle of the first rotary member located at the wood-infeeding side end may be set greater than the inclined angle of the (n−1)-th rotary member located before the wood-outfeeding side end, and the inclined angles of the second to (n−2)-th rotary members may be set within a range from an angle equal to or greater than the inclined angle of the (n−1)-th rotary member to an angle equal to or less than the inclined angle of the first rotary member and may each be set equal to or greater than the inclined angle of an adjoining rotary member which is located on the wood-infeeding side.

In this case, the first to (n−1)-th rotary members may employ the structures of the rotors in the first to third embodiments, thus improving the debarking efficiency. The inclined angle of the n-th rotary member should be set large to quicken the discharging of wood on the wood-outfeeding side.

What is claimed is:

1. A debarking machine having a wood-infeeding side for feeding wood to said debarking machine and a wood-outfeeding side for outputting wood from said debarking machine, said debarking machine comprising:

one of a line of first to n-th rotary members coupled in series, and a plurality of lines thereof coupled in series, from said wood-infeeding side to said wood-outfeeding side, each rotary member having a debarking blade on an outer surface, wherein said first rotary member is inclined downwardly in a direction toward said wood-outfeeding side from said wood-infeeding side and said second to n-th rotary members are arranged one of horizontally and inclined downwardly in said direction toward said wood-outfeeding side from said wood-infeeding side, wherein an inclined angle of said first rotary member located at an end of said wood-infeeding side is set greater than an inclined angle of said n-th rotary member located at an end of said wood-outfeeding side, and wherein inclined angles of said second to (n−1)-th rotary members are set within a range from an angle no less than said inclined angle of said n-th rotary member to an angle no more than said inclined angle of said first rotary member and are each set no less than said inclined angle of an adjoining rotary member which is located on said wood-infeeding side.

2. The debarking machine according to claim 1, wherein each of said rotary members is rotatably accommodated in a housing to constitute a debarking unit.

3. The debarking machine according to claim 1, wherein said inclined angle of said first rotary member positioned at said wood-infeeding side end is set greater than said inclined angles of subsequent rotary members.

4. The debarking machine according to claim 1, wherein said inclined angles of said first rotary member positioned at said wood-infeeding side end and said second rotary member next to said first rotary member are set greater than said inclined angles of subsequent rotary members.

5. The debarking machine according to claim 3, wherein said inclined angles of said subsequent rotary members are set the same.

6. The debarking machine according to claim 1, wherein said inclined angle of said first rotary member positioned at said wood-infeeding side end is set to a maximum angle, and said inclined angles of other rotary members are reduced toward said wood-outfeeding side.

7. The debarking machine according to claim 1, wherein a difference between said inclined angles of said adjoining rotary members are set less than 6°.

8. The debarking machine according to claim 1, wherein said inclined angles of said rotary members are adjustable.

9. A debarking machine having a wood-infeeding side for feeding wood to said debarking machine and a wood-outfeeding side for outputting wood from said debarking machine, said debarking machine comprising:

one of a line of first to n-th rotary members coupled in series, and a plurality of lines thereof coupled in series, from said wood-infeeding side to said wood-outfeeding side, each rotary member having a debarking blade on an outer surface, wherein said first rotary member is inclined downwardly in a direction toward said wood-outfeeding side from said wood-infeeding side and said second to (n−1)-th rotary members are arranged one of horizontally and inclined downwardly in said direction toward said wood-outfeeding side from said wood-infeeding side, wherein an inclined angle of said first rotary member located at an end of said wood-infeeding side is set greater than an inclined angle of said (n−1)-th rotary member located before an end of said wood-outfeeding side, and wherein inclined angles of said second to (n−2)-th rotary members are set within a range from an angle no less than said inclined angle of said (n−1)-th rotary member to an angle no more than said inclined angle of said first rotary member and are each set no less than said inclined angle of an adjoining rotary member which is located on said wood-infeeding side.

10. The debarking machine according to claim 2, wherein said inclined angle of said first rotary member positioned at said wood-infeeding side end is set greater than said inclined angles of subsequent rotary members.

11. The debarking machine according to claim 2, wherein said inclined angles of said first rotary member positioned at said wood-infeeding side end and said second rotary member next to said first rotary member are set greater than said inclined angles of subsequent rotary members.

12. The debarking machine according to claim 4, wherein said inclined angles of said subsequent rotary members are set the same.

13. The debarking machine according to claim 2, wherein said inclined angle of said first rotary member positioned at said wood-infeeding side end is set to a maximum angle, and said inclined angles of other rotary members are reduced gradually toward said wood-outfeeding side.

14. The debarking machine according to claim 2, wherein a difference between said inclined angles of said adjoining rotary memebers are set less than 6°.

15. The debarking machine according to claim 2, wherein said inclined angles of said rotary members are adjustable.

16. The debarking machine according to claim 11, wherein said inclined angle of said first rotary member positioned at said wood-infeeding side end is set greater than said inclined angles of subsequent rotary members.

17. The debarking machine according to claim 12, wherein said inclined angle of said first rotary member positioned at said wood-infeeding side end is set greater than said inclined angles of subsequent rotary members.

* * * * *